US008993494B2

(12) United States Patent
Kusuura

(10) Patent No.: US 8,993,494 B2
(45) Date of Patent: Mar. 31, 2015

(54) COMPOSITIONS COMPRISING REVERSE MICELLES AND METHODS FOR THEIR USE

(75) Inventor: Takahisa Kusuura, Kanagawa (JP)

(73) Assignee: Empire Technology Development LLC, Wilmington, DE (US)

( * ) Notice: Subject to any disclaimer, the term of this patent is extended or adjusted under 35 U.S.C. 154(b) by 501 days.

(21) Appl. No.: 13/144,544

(22) PCT Filed: Dec. 1, 2010

(86) PCT No.: PCT/JP2010/071941
§ 371 (c)(1),
(2), (4) Date: Jul. 14, 2011

(87) PCT Pub. No.: WO2012/073385
PCT Pub. Date: Jun. 7, 2012

(65) Prior Publication Data

US 2012/0141681 A1 Jun. 7, 2012

(51) Int. Cl.
*C10M 169/04* (2006.01)
*C10M 141/06* (2006.01)
(Continued)

(52) U.S. Cl.
CPC ..... *C10M 169/04* (2013.01); *C10M 171/00* (2013.01); *C10M 141/06* (2013.01); *C10N 2230/60* (2013.01); *C10N 2230/02* (2013.01); *C10M 2201/041* (2013.01); *C10M 2201/05* (2013.01); *C10M 2201/061* (2013.01); *C10M 2201/066* (2013.01); *C10M 2201/102* (2013.01); *C10M 2201/103* (2013.01); *C10M 2213/062* (2013.01); *C10M 2215/182* (2013.01); *C10M 2227/081* (2013.01); *C10M 2227/09* (2013.01); *C10M 2203/1006* (2013.01); *C10M 2203/1025* (2013.01); *C10M 2203/1065* (2013.01); *C10M 2205/0285* (2013.01); *C10M 2207/125* (2013.01); *C10M 2207/128* (2013.01);
(Continued)

(58) Field of Classification Search
USPC ..... 508/100, 110, 463, 546
See application file for complete search history.

(56) References Cited

U.S. PATENT DOCUMENTS 4,767,669 A 8/1988 Conklin et al.
5,274,171 A * 12/1993 Chalk et al. ..... 560/104
5,374,367 A 12/1994 Edamura et al.

FOREIGN PATENT DOCUMENTS

EP 0588482 A2 3/1994
EP 1683853 A1 7/2006
(Continued)

OTHER PUBLICATIONS

Sakai, H., Orihara, Kodashima, H., Matsumura, A., Okhubo, T., Tsuchiya, K., and Abe, M, "Photoinduced Reversible Change of Fluid Viscosity", J. Am. Chem. Soc., 2005, 127, 13454-13455.*
(Continued)

*Primary Examiner* — James Goloboy
(74) *Attorney, Agent, or Firm* — Pepper Hamilton LLP

(57) ABSTRACT

Compositions containing a reverse micelle comprising a first compound and a second compound are disclosed, wherein the second compound is configured to change conformation in response to a stimulus, a first conformation selected for formation of the reverse micelle, and a second conformation selected for disruption of the reverse micelle; and wherein the first compound is selected to interact with the first conformation of the second compound to form the reverse micelle.

32 Claims, 5 Drawing Sheets

(51) Int. Cl.
*C10M 133/28* (2006.01)
*C10M 129/50* (2006.01)
*C10M 171/00* (2006.01)

(52) U.S. Cl.
CPC ..... *C10M2207/26* (2013.01); *C10M 2207/283* (2013.01); *C10M 2207/2835* (2013.01); *C10M 2229/02* (2013.01); *C10N 2250/10* (2013.01)
USPC ..... 508/110; 508/100; 508/463; 508/546

(56) References Cited

FOREIGN PATENT DOCUMENTS

| | | | | |
|---|---|---|---|---|
| JP | 04-348194 | | | 12/1992 |
| JP | 06-073390 | | | 3/1994 |
| JP | 06-145682 | | | 5/1994 |
| JP | 06145682 | A | * | 5/1994 |
| JP | 11-092776 | | | 4/1999 |
| JP | 2005-290203 | | | 10/2005 |
| JP | 2005290203 | A | * | 10/2005 |
| JP | 2007-332309 | | | 12/2007 |
| JP | 2008-231489 | | | 10/2008 |
| JP | 2009-062467 | | | 3/2009 |
| JP | 2011-029508 | | | 2/2011 |

OTHER PUBLICATIONS

English-language machine translation of JP 2005-290203 A.*
International Search Report and Written Opinion, PCT/JP2010/071941, dated Mar. 22, 2011.
Shrestha et al., Wormlike Micelles in Mixed Amino Acid Surfactant/Nonionic Surfactant Aqueous Systems and the Effect of Added Electrolytes, *J Oleo Sci* (2009), 58(5):243-254.
Management Techniques and Recent Developments in the Oil Press, printed from website; http://www.juntsu.co.jp/qa/qa0633.html.
Saki et al., Viscous Solution in the Electro-Optical Control; printed from website http://pfi.iis.u-tokyo.ac.jp/res03sk.pdf.
Surfactants by various conditions, printed from website http://www.rs.noda.tus.ac.jp/~abemasa/about_our_lab/kennkyuu/Dezain/D_d/D_d_1/D_d_1.html.
The Collapse or the Formation of Molecular Aggregates in Aqueous Surfactant Solution Properties, printed from website http://www.rs.noda.tus.ac.jp/~abemasa/about_our_lab/kennkyuu/Dezain/D_d/D_d_2/D_d_2.html.
Tsuchiya et al., Photoinduces Viscosity Change of Wormlike Micellar Solution with Cinnamate.
Protective Effects of Anti-Rust Oil, printed from website http://web.kyoto-inet.or.jp/people/macchann/hiroshi/bousei.html.
Sodium Salicylate, printed from website http://en.wikipedia.org/wiki/Sodium_salicylate.
Sodium Bromide, printed from website http://en.wikipedia.org/wiki/Sodium_bromide.
Pressed Oil, ID-340 Oil Press Processing, printed from website http://www.jalos.jp/jalos/qa/articles/006-340.htm.
Optical Rheology of String-Like Reverse Micellar Solution J, printed from website http://jglobal.jst.go.jp/public/20090422/200902270429174049.
Pinna, Nanoparticle Synthesis in Reverse Micelles, Max Planck Institute of Colloids and Interfaces.
Pileni, Reverse Micelles Used as Templates: a New Understanding in Nanocrystal Growth, Journal of Experimental Nanoscience, Mar. 2006, vol. 1, No. 1, 13-27.
Canter, Challenges in Formulating Metal-Forming Fluids, Tribology & Lubrication Technology, Mar. 2009.
Chemical Product Group: Lubrication Additives, printed from website http://www.pilotchemical.com/productapplications/index/1.
Viscosity, printed from website http://en.wikipedia.org/wild/Viscosity.
How to Seek and Viscosity of Lubricant Mixing—ID-Hardness Determination of the Viscosity of the Lubricant Mixture and L243, printed from L243, printed from website http://www.jalos.jp/jalos/qa/articles/009-L243.htm.
How to Calculate Viscosity of Liquid Mixture?, printed from website http://profmaster.blogspot.com/2007/12/how-to-calculate-viscosity-of-liquid.html.
Mixing Viscosities—Mixing Oils, printed from website http://widman.biz/English/Calculators/Mixtures.html.
Reamer Series, printed from website http://www.nikken-kosakusho.co.jp/reama.htm.
Sep. 2010 for Supply and Demand Trends in the Western U.S. and Asia Lubricant, printed from website http://www.jalos.or.jp/stat/lub_stat_oversea_02.pdf.
Sakai, et al., Photoinduced Reversible Change of Fluid Viscosity, J. Am Chem Soc. Oct. 5, 2005, 127(39):13454-5.
Wang, et al., Using Flotation to Separate Oil Spill Contaminated Beach Sands, J. Envir. Engrg. vol. 136, Issue 1, pp. 147-151 (Jan. 2010).
Sakai, Control of Interfacial Properties with Photo-Switchable Surfactants, Oleoscience, vol. 4, No. 12 (2004).
JX Nippon Oil & Energy Corporation product information, printed from website, http://www.eneos.co.jp/business/product/lubricants/metal/pdf/ind-5518-0904.pdf.
Corrosion Inhibitors for Oilfield Production, Akzo Nobel Surfactants, Products for the Petroleum Industry, 2006 Akzo Nobel Surface Chemistry LLC, Publication S-06-17.
ENEOS Industrial series chlorine-based and lead-based additives additive-free plastic working oil Uni PlayStation Lami Series, accessed at http://web.archive.org/web/20090603065046/http://www.eneos.co.jp/business/lubricants/metal/unicut/e71_bulumeun_press.html, accessed on Oct. 22, 2004, pp. 1-3.
Tsuchiya et al., Control of Viscoelasticity Using Redox Reaction, *J. Am. Chem. Soc.* (Sep. 11, 2004), 126(36):12282-12283.

* cited by examiner

COMPOSITIONS COMPRISING REVERSE MICELLES AND METHODS FOR THEIR USE

CLAIM OF PRIORITY

This application is a U.S. national stage application under 35 U.S.C. §371 of International Application No. PCT/JP2010/071941, filed Dec. 1, 2010, entitled "COMPOSITIONS COMPRISING REVERSE MICELLES AND METHODS FOR THEIR USE," the disclosure of which is incorporated by reference in its entirety.

TECHNICAL FIELD

The present disclosure relates to compositions comprising one or more reverse micelles, and methods for their preparation and use. The compositions have switchable viscosities, due to the formation or disruption of the micelles.

BACKGROUND

In the industrial field, especially in the machine industry, various types of cleaners are used in large quantities to remove machining or preservative oils from machine parts. Recently, efforts such as the use of water-soluble cleaners have begun to be taken to reduce environmental burdens, but more efforts are still needed. Oils used in the machine industry are used for lubrication in machining (e.g., press working) or for protection against rust during storage and have to be highly viscous or adherent. This makes them difficult to be removed. Oils that are difficult to be removed from machine parts significantly affect the subsequent processes other than washing, such as welding, secondary processing, painting, plating and bonding, and also affect the washing system itself when washing is performed.

DETAILED DESCRIPTION

Figure 1:
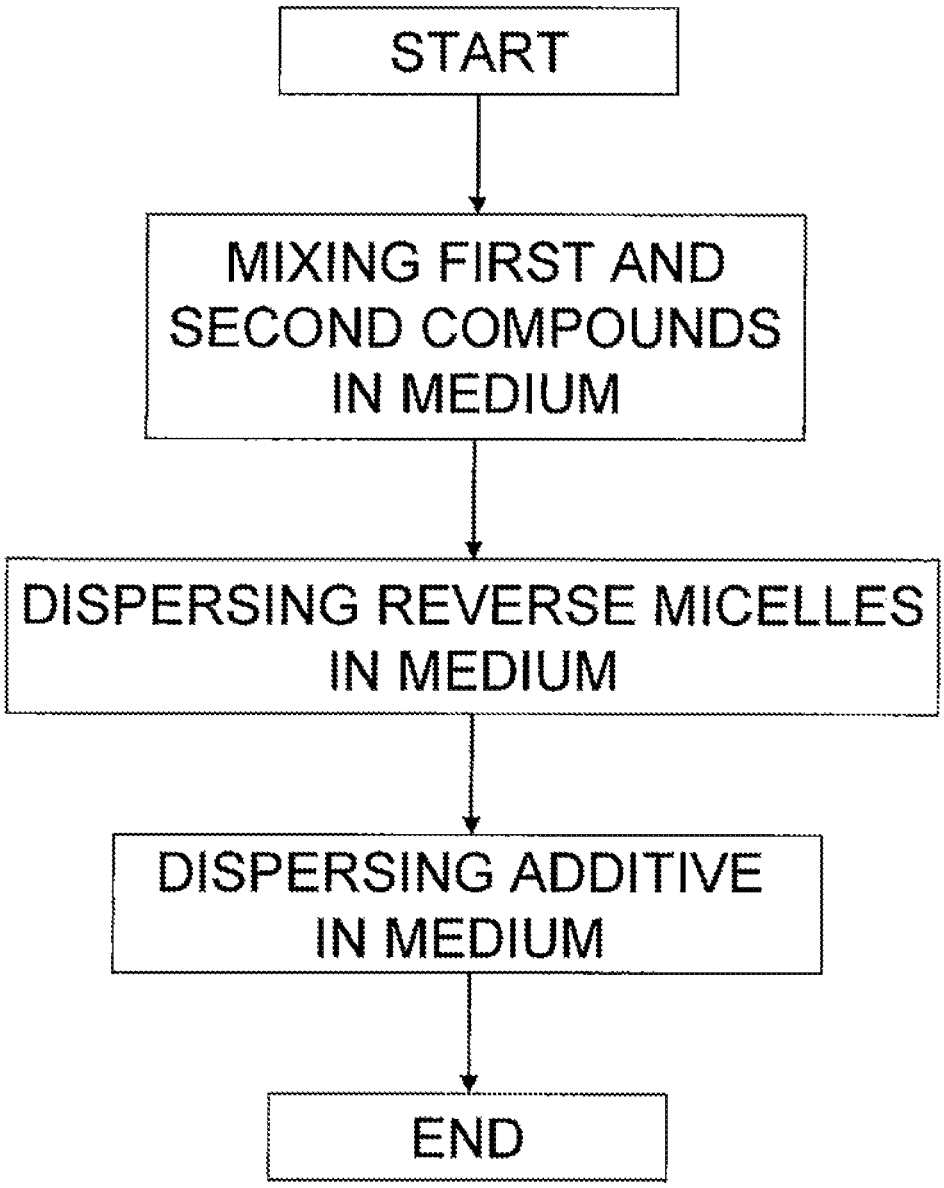
FIG. 1 is a flow chart showing an example of a process for preparing the composition comprising a reverse micelle.

In the following detailed description, reference is made to the accompanying drawings, which form a part hereof. The illustrative embodiments described in the detailed description, drawings, and claims are not meant to be limiting. Other embodiments may be used, and other changes may be made, without departing from the spirit or scope of the subject matter presented herein. It will be readily understood that the aspects of the present disclosure, as generally described herein, and illustrated in the Figures, may be arranged, substituted, combined, separated, and designed in a wide variety of different configurations, all of which are explicitly contemplated herein.

Compositions, machine oils, press working oils, antirust oils, processes for preparing the compositions and methods for using the compositions are disclosed. The compositions can comprise at least one reverse micelle comprising a first compound and a second compound. The second compound is configured to change conformation from a first conformation to a second conformation, or from a second conformation to a first conformation, in response to a stimulus. The change in conformation can be reversible or irreversible. A first conformation is compatible with formation of the reverse micelle, while a second conformation is not compatible with formation of the reverse micelle, and may either inhibit formation of, or disrupt a previously formed reverse micelle. Examples of conformations include cis- and trans-isomers of compounds, or conformational or configurational isomers (sometimes referred to as "conformers" or "rotamers") such as staggered or eclipsed isomers. The first compound is selected to interact with the first conformation of the second compound to form the reverse micelle. The second compound is capable of forming the reverse micelle with the first compound. The presence or absence of one or more reverse micelles in the compositions will affect the viscosity of the composition, where increasing the number or concentration of reverse micelles will increase the viscosity of the composition, and decreasing the number or concentration of reverse micelles will decrease the viscosity of the composition. A composition containing reverse micelles can maintain sufficient viscosity for machining applications or storage, and can subsequently be removed using little or no cleaner by disrupting the reverse micelle and lowering the viscosity of the composition. While compositions are described as containing at least one reverse micelle, compositions may contain large numbers of reverse micelles, depending on the volume and concentration of the composition.

The second compound can generally be any one or more compounds having the above described two conformations. In one example, the second compound can comprise a surfactant. The surfactant can form a reverse micelle with the first compound in response to a stimulus such as photostimulation or electric stimulation. The reverse micelle can have a structure in which hydrophilic groups of the second compound are arranged towards the micelle core, and hydrophobic groups are arranged towards the outer phase such as an oil phase. The surfactant can change its structure in response to a stimulus in order to change the hydrophilic-hydrophobic balance such that a formation and/or disruption of a reverse micelle are possible. Various stimuli can be used, such as photostimulation and electrical stimulation.

A surfactant changing its structure in response to the photostimulation can undergo reversible structural changes. Reversible changes of the surfactant can be, for example, conformational changes in response to irradiation with light having a particular wavelength (e.g. visible light) and then return to the original conformation in response to irradiation with light having another particular wavelength (e.g. ultraviolet light). Appropriate wavelengths for a particular surfactant may be known or readily determined. Examples of surfactants that undergo conformational changes in response to photostimulation include photoswitchable azobenzene-modified surfactants. Specific examples of photoswitchable azobenzene-modified surfactants include quaternary ammonium salts of azobenzene compounds.

Figure 3:
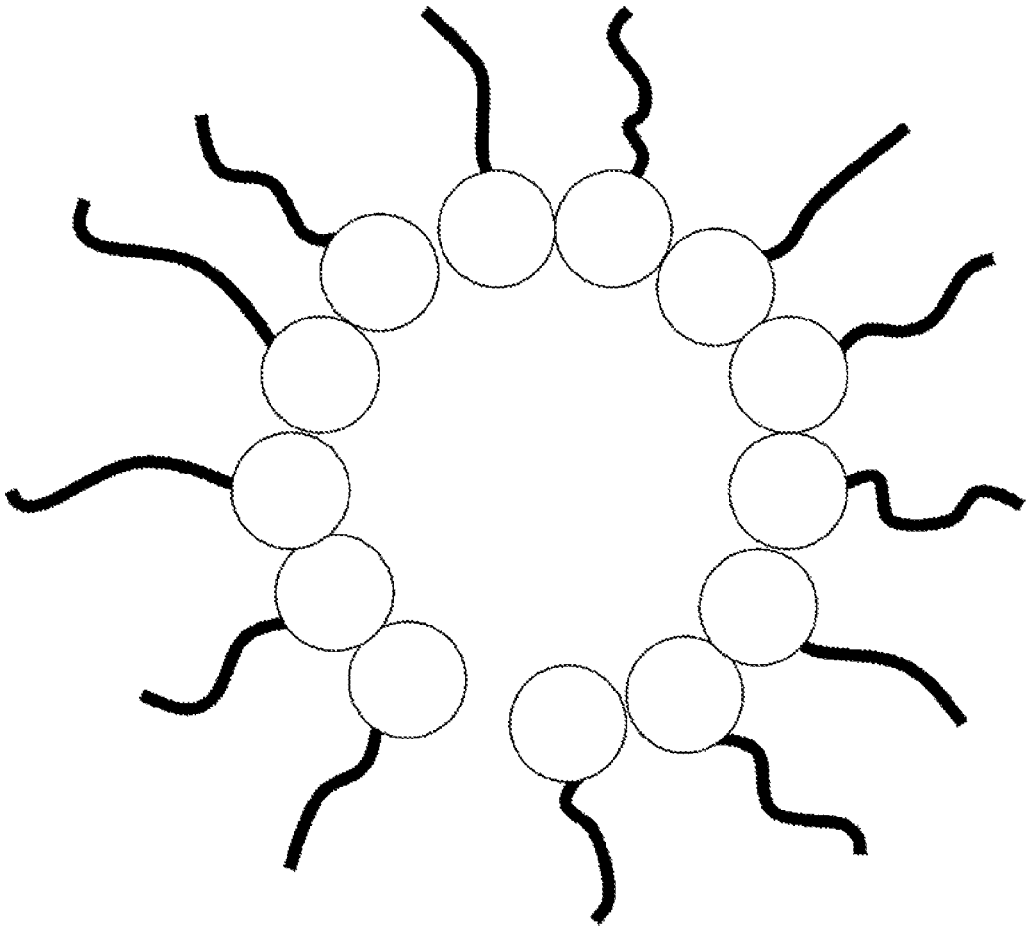
FIG. 3 is a view schematically showing a reverse micelle.
Figure 4A:
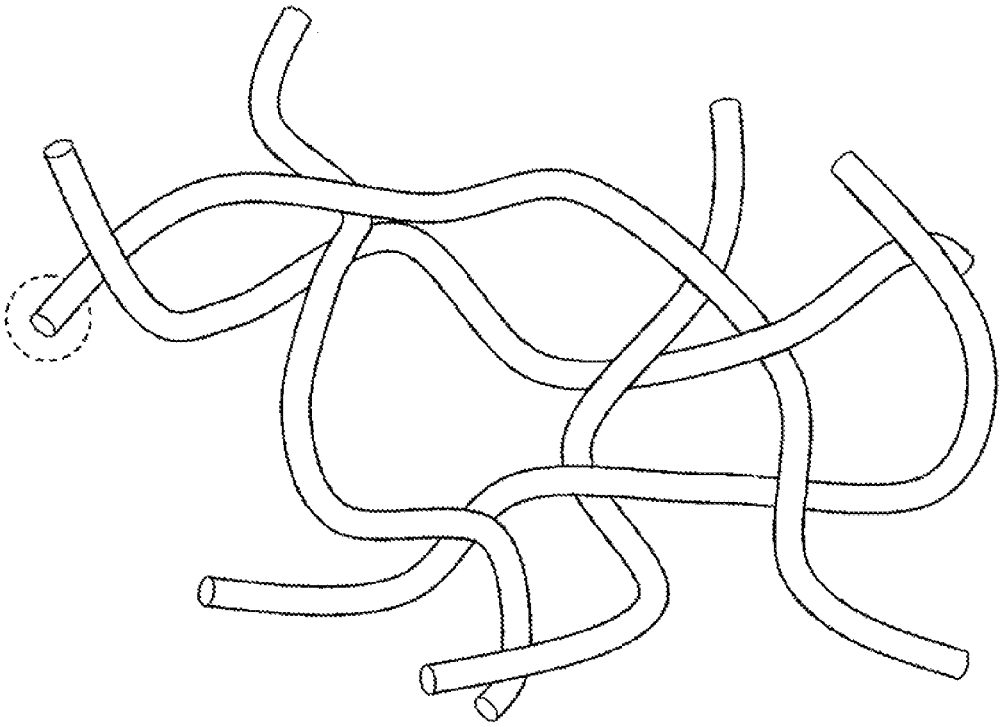
FIG. 4A is a view schematically showing a reverse wormlike micelle.
Figure 4B:
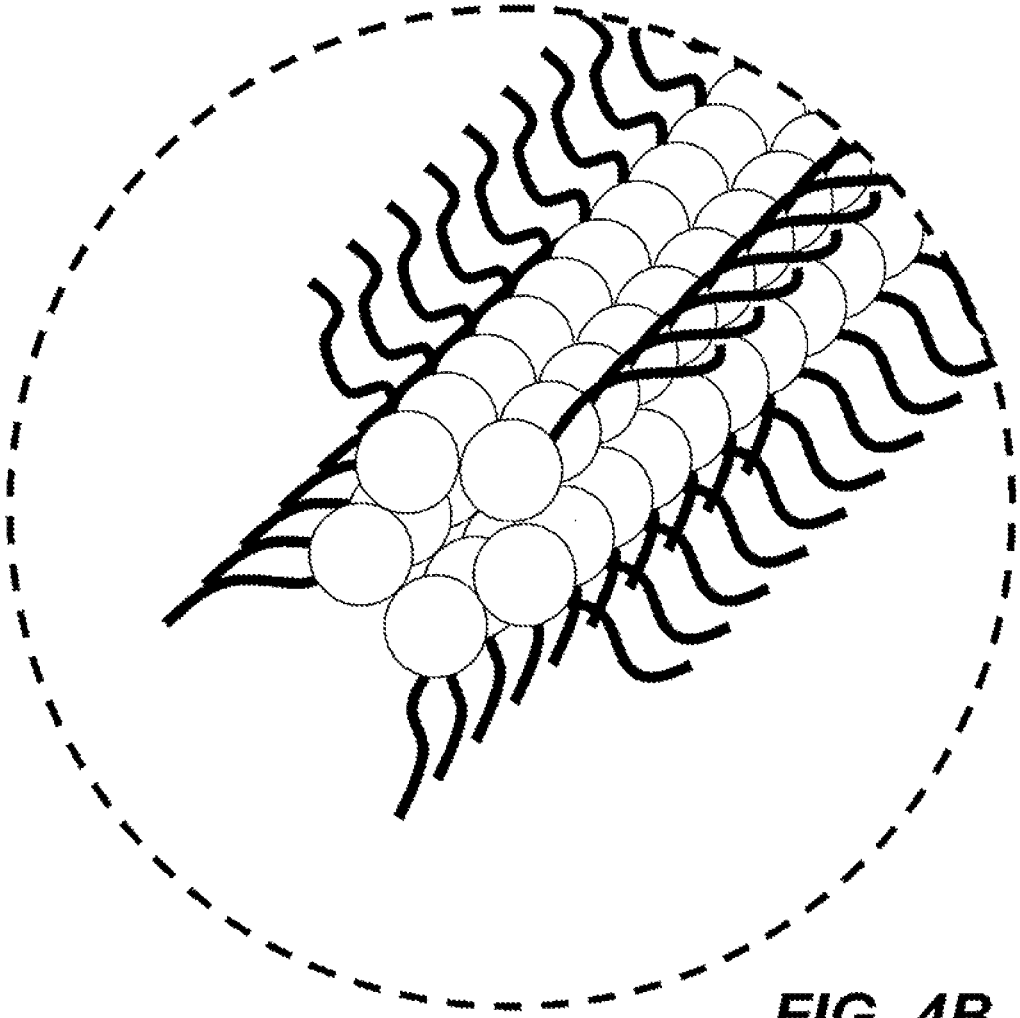
FIG. 4B is a partially enhanced view of the reverse wormlike micelle shown in FIG. 4A.

Compositions containing reverse micelles formed with quaternary ammonium salts of azobenzene compounds exhibit a high degree of change in viscosity when the reverse micelles are disrupted by structural changes in the second compound, and thus can be easily removed from articles such as machine parts. This quaternary ammonium salt can change into a trans-isomer in response to irradiation of visible light, and form a reverse micelle (see FIG. 3) with the first compound and second compound forming a reverse micelle. When the reverse micelle structure forms a reverse wormlike micelle structure (see FIGS. 4A and 4B), the viscosity of the composition can be further increased due to entanglement of the reverse wormlike micelles. On the other hand, the quaternary ammonium salt can change into a cis-isomer in response to irradiation of ultraviolet light to disrupt or inhibit formation of the reverse micelle, and as a result, the viscosity of the composition is decreased. A specific example of such a compound is represented by the following formula (1), combining an azobenzene moiety with a quaternary ammonium salt moiety:

(1)

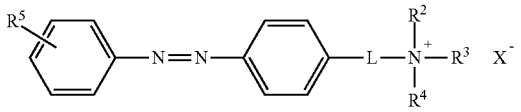

In the formula, $R^2$, $R^3$ and $R^4$ each independently represent a lower alkyl group such as an alkyl group having 1 to 6 carbon atoms or form a pyridinium with the nitrogen atom, $R^5$ represents an alkyl group, L represents an alkylene group or an alkylene-oxy group and X represents a halogen atom.

The lower alkyl group can be a methyl group. $R^5$ can be an alkyl group having 4 to 8 carbon atoms, such as a butyl group, hexyl group or octyl group. L can be an alkylene-oxy group such as an ethylene-oxy group. X can be a bromine atom or a chlorine atom.

Specific examples of quaternary ammonium salts of azobenzene compounds include 4-butylazobenzene-4'-(oxyethyl)trimethylammonium bromide or chloride, 4-hexylazobenzene-4'-(oxyethyl)trimethylammonium bromide or chloride, and 4-octylazobenzene-4'-(oxyethyl)trimethylammonium bromide or chloride. One photoswitchable azobenzene-modified surfactant can be used alone, or two or more photoswitchable azobenzene-modified surfactants can be used in combination.

Alternatively, a surfactant which forms a reverse micelle with the first compound can comprise a quaternary ammonium salt other than a photoswitchable azobenzene-modified surfactant. Such quaternary ammonium salt can be used together with the photoswitchable azobenzene-modified surfactant, or can be used instead of the photoswitchable azobenzene-modified surfactant. When the quaternary ammonium salt is used together with the photoswitchable azobenzene-modified surfactant, the photoswitchable azobenzene-modified surfactant itself can contribute to the formation and disruption of a reverse micelle as at least a part of the reverse micelle. Alternatively, the photoswitchable azobenzene-modified surfactant itself may not be incorporated in the reverse micelle, but can promote the formation or disruption of the reverse micelle by the quaternary ammonium salt. When the composition includes such quaternary ammonium salt instead of the photoswitchable azobenzene-modified surfactant, the composition can include at least one selected from a group consisting of a substituted or unsubstituted cinnamic acid, salt thereof and an ester thereof.

The quaternary ammonium salt can generally be any quaternary ammonium salt. A specific example of a quaternary ammonium salt can be represented by the following formula (2):

(2)

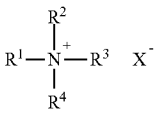

wherein $R^1$ represents an alkyl group having 14 to 18 carbon atoms, $R^2$, $R^3$ and $R^4$ each independently represent a lower alkyl group such as an alkyl group having 1 to 6 carbon atoms or form a pyridinium with the nitrogen atom, $R^5$ represents an alkyl group, L represents an alkylene group or an alkylene-oxy group and X represents a halogen atom.

For example, the quaternary ammonium salt can include at least one selected from the group consisting of cetyltrimethylammonium bromide or chloride, cetylpyridinium chloride, octadecyltrimethylammonium bromide or chloride and octadecylpyridinium chloride, or can include cetyltrimethylammonium bromide.

An alternative to photostimulation is electrical stimulation. A surfactant changing its structure in response to the electric stimulation can undergo reversible or irreversible structural changes. When the surfactant's conformational changes are reversible, the formation and disruption of a reverse micelle may also be reversible. When the surfactant's conformation changes are irreversible, the formation and disruption of a reverse micelle may also be irreversible. Reversible changes of the surfactant can be, for example, conformational changes in response to electrolytic oxidation and return to the original conformation in response to electrolytic reduction, and vice versa. Specific examples of such surfactants include redox-active ferrocenyl surfactants. Examples of redox-active ferrocenyl surfactants include (11-ferrocenylundecyl)trimethylammonium bromide. In the redox-active ferrocenyl surfactant, the N terminals are hydrophilic groups and the ferrocene terminals are hydrophobic (lipophilic) groups in the absence of electric stimulation (in the reduced state). In this state, since it is difficult for the reverse micelle to form, and consequently it is also difficult for the reverse wormlike micelle to form, the viscosity of the composition is low. On the other hand, when the redox-active ferrocenyl surfactant is oxidized in response to electric stimulation, the ferrocene terminals are changed into hydrophilic groups. As a result, the hydrophilic-hydrophobic balance changes, forming the reverse micelle (see FIG. 3). With this reverse micelle, the reverse wormlike micelle structure (see FIGS. 4A and 4B) is more easily assembled, which results in a further increase in the viscosity of the composition.

The first compound, which interacts with the first conformation of the second compound to form the reverse micelle, can generally be any compound that so interacts. For example, the first compound can comprise at least one compound selected from the group consisting of a substituted or unsubstituted cinnamic acid, a salt thereof and an ester thereof. Specific examples of the compound include cis-cinnamic acid, trans-cinnamic acid, sodium cinnamate, potassium cinnamate, α-methylcinnamic acid, 2-methylcinnamic acid, 2-fluorocinnamic acid, 2-(trifluoromethyl)cinnamic acid, 2-chlorocinnamic acid, 2-methoxycinnamic acid, 2-hydroxycinnamic acid, 2-nitrocinnamic acid, 2-carboxycinnamic acid, trans-3-fluorocinnamic acid, 3-(trifluoromethyl) cinnamic acid, 3-chlorocinnamic acid, 3-bromocinnamic acid, 3-methoxycinnamic acid, 3-hydroxycinnamic acid, 3-nitrocinnamic acid, 4-methylcinnamic acid, 4-fluorocinnamic acid, trans-4-(trifluoromethyl)-cinnamic acid, 4-chlorocinnamic acid, 4-bromocinnamic acid, 4-methoxycinnamic acid, 4-hydroxycinnamic acid, 4-nitrocinnamic acid, 3,3-dimethoxycinnamic acid, ethyl 4-methoxycinnamate, isopropyl 4-methoxycinnamate, octyl 4-methoxycinnamate, 2-ethoxyethyl 4-methoxycinnamate, sodium 4-methoxycinnamate, potassium 4-methoxycinnamate and glyceryl ethylhexanoate dimethoxycinnamate. The first compound can optionally undergo structural changes such as isomerization or dimerization in response to photostimulation such as irradiation with visible light or ultraviolet light. A structural change in the first compound can promote formation or disruption of the reverse micelle by the second compound. For example, when the first compound is changed from a trans-isomer into a cis-isomer by isomerization, this can promote disruption of the reverse micelle, and when the first compound is changed from a cis-isomer into a trans-isomer, this can promote formation of the reverse micelle. The wavelength of light used for the first compound to promote the second compound to form a reverse micelle can generally be any wavelength, and can be in the range of, for example, about 230 nm to about 255 nm, and the wavelength of light used for the first compound to promote the second compound to inhibit or disrupt the reverse micelle can be in the range of, for example, about 260 nm to about 400 nm. The first compound that undergoes structural changes under photodimerization reaction can disrupt or inhibit the reverse micelle with the photodimerization. Photodimerization can be reversible or irreversible.

The first compound can comprise at least one selected from the group consisting of an organic acid, an organic salt, sodium bromide, sodium chloride and hydrogen phthalate. Salicyclic acid is a specific example of an organic acid. Sodium salicylate is a specific example of an organic salt. These first compounds can provide a reversible viscosity change to the composition when used in combination with the second compound. Since the melting point of sodium salicylate is 211° C. at a pressure of 20 mm Hg, the composition can be used in cold press working at room temperature, while it is a less desirable choice for use at high temperatures. In a process involving a high degree of processing (or deformation) expected to generate intense heat due to friction (for example, up to 400° C.), the composition can include sodium bromide which has a high boiling point of 1390° C. at ordinary pressure. In this way, the first compound can be selected depending on the environment in which the composition is used, such as the temperature and the atmosphere.

The composition can further comprise a disperse medium, in which reverse micelles are dispersed. The disperse medium can generally be any suitable material. An example of a disperse medium is an oil. The oil included in the composition can generally be any oil. Specific examples of oils include mineral oil, plant oil and synthetic oil. Other examples include paraffin oil, naphthene oil, aliphatic acid or derivatives thereof, grease-based oil, poly-α-olefin, polyol ester and siloxane. The derivative of the aliphatic acid can include an alkaline metal salt of lanolin acid. The disperse medium can contain one oil or mixtures of two or more oils.

Oils may be selected based upon the intended use or application of the composition. For example, when the composition is used for press working, paraffin oil or naphthene oil can be included as an oil. Oils can also be selected based upon physical or chemical characteristics such as their heat stability, cold gelling, antioxidizing property or extreme-pressure property based upon the intended use or application of the composition.

When the oil composition is used to confer protection against rust for a metallic article, for example by being applied onto the surface of the article, the antirust effect can be increased due to the composition's removal of rust-inducing substances adhered to the article's surface. The second compound can be adsorbed onto the article's surface to avoid adsorption or direct contact of rust-inducing substances such as water or oxygen. The second compound may additionally displace substances already adsorbed onto the article's surface. In addition, since the reverse micelle can incorporate water, the composition can prevent water from directly contacting the surface of the article. A composition used for protection against rust can include mineral oil and/or synthetic oil, a lanolin acid derivative, or plant oil. Examples of lanolin acid derivatives include an alkaline metal salt of lanolin acid. The composition used for protection against rust can include one or more oils such as grease-based oil, naphthene-base mineral oil, paraffin-base mineral oil, poly-α-olefin, polyol ester, and polydimethyl siloxane.

The composition can include one or more additional additives. Examples of additives include viscosity improvers, oiliness improvers, extreme-pressure additives; solid lubricants, antirust agents, antioxidizing agents, anticorrosives, emulsifiers and solublizers. Examples of the oiliness improvers include fats/oils such as colza oil, soybean oil and lard, fatty acids such as oleic acid and stearic acid, higher alcohol such as oleyl alcohol and stearyl alcohol, and esters such as fatty acid ester. Examples of extreme-pressure additives include chlorine-based extreme-pressure additives such as chlorinated paraffin and chlorinated fatty acid, sulfur-based extreme-pressure additives such as polysulfide, sulfurated mineral oil and sulfurated fats/oils, phosphorus-based extreme-pressure additives such as alkyl phosphoric acid ester, and complex extreme-pressure additives such as thiophosphate. Examples of solid lubricants include particulate solid lubricants such as talc, metal powder and polytetrafluoroethylene, and layered solid lubricants such as graphite, molybdenum disulfide ($MoS_2$), boron nitride (BN), and mica. Examples of antirust agents include sulfonate, carboxylate and amine salt. Examples of antioxidizing agents include phenolic compounds and amine salts. Examples of anticorrosives include benzotriazole. One or more additives can be added to the compositions. Examples of commonly used oil additives include Aristonate® series, Calamide® series, Calimulse® EM-95, Calsoft® OS-45S and Pilot® series of Pilot Chemical Company.

The composition can in some cases contain water. If the composition contains a small amount of water, the hydrophilic groups of the second compound surround the water in the composition's reverse micelles. Such reverse micelles can exist in a more stabilized manner based on the interaction between the hydrophilic groups and the water, and thus a composition with a high viscosity can be obtained. If the composition substantially does not contain water, the antirust effect for a metallic article can be increased when the composition is applied on the article, as the reverse micelles can sequester water that subsequently contacts the article. The amount of water added to the composition can be selected accordingly. Example concentrations of water include 0% (no water added), or about 1% to about 10% by weight with respect to the total weight of the composition.

The composition can generally be prepared by any suitable process. For example, a second compound, a first compound, and if desired, water are added and mixed in a disperse medium, and then stirred, for example, with a stirrer, such that a composition can be obtained in a state in which a reverse micelle formed by the first and second compounds is dispersed in the medium. The various components can be combined stepwise or all at once. If the composition contains additives, the composition can be prepared in accordance with the flow chart shown in FIG. 1. Firstly, a second compound, a first compound, and if desired, water are added and mixed in a disperse medium to obtain reverse micelles. Subsequently, reverse micelles formed from the first and second compounds are dispersed in the medium by stirring. Then, additives are added to the mixture (dispersion) and further stirred such that a composition can be obtained in a state in which the additives are also dispersed in the medium. This stepwise approach may be useful if the additives are known or suspected of inhibiting the formation of the reverse micelle. Alternatively, additives may be added to the first compound and second compound prior to formation of the reverse micelles.

The viscosity of the composition with a reverse micelle and the viscosity of the composition without a reverse micelle can be controlled by adjusting the combination and the compounding ratio of each component contained in the composition or by selecting the second compound in consideration of the molecular configuration of the second composition (e.g. length of the long chain portion such as alkyl group).

The viscosity of the composition with a reverse micelle can be selected according to its intended use. For example, when the composition is used as a machining oil such as a press working oil, its viscosity can be about $10\times10^{-3}$ to about $1000\times10^{-3}$ Pa·s at 40° C. When the oil composition is used as an anti-rust oil, its viscosity can be about $4\times10^{-3}$ Pa·s or more at 40° C.

The lower the viscosity of the composition without a reverse micelle is, the easier it is to remove the composition from articles or to apply the composition into pores or holes of the article. For example, considering that the viscosity of water is $0.65\times10^{-3}$ Pa·s at 40° C., the composition can have a viscosity near water or even lower for easy application and removal. For example, the viscosity of the composition without a reverse micelle can be about $2\times10^{-3}$ Pa·s or less at 40° C.

The viscosity of the composition can be estimated, for example, by proportional calculation, from the viscosity of each individual component or the viscosity of when a certain component is dissolved in another component. Therefore, after each component is combined based on such estimation and the viscosity of the composition is measured, a composition with a desired viscosity can be obtained by making a fine adjustments to the compounding ratio of each component. The composition can be prepared by referring to or using JIS Handbook No. 25, Oil Volume (2001 edition), or ASTM D341-93 (1998).

The predicted decrease in viscosity when a certain second component is used can be estimated to some extent. Since the formation of the reverse micelle is an exactly opposite phenomenon from the disruption of the reverse micelle, the degree of increase in viscosity is the same as the degree of decrease in viscosity for the disruption. Therefore, after each component is combined based on the above-mentioned estimation and the degree of decrease or increase in viscosity of the composition is measured, a composition with a desired degree of decrease or increase in viscosity can be obtained by making fine adjustments to the compounding ratio of each component.

Figure 2:
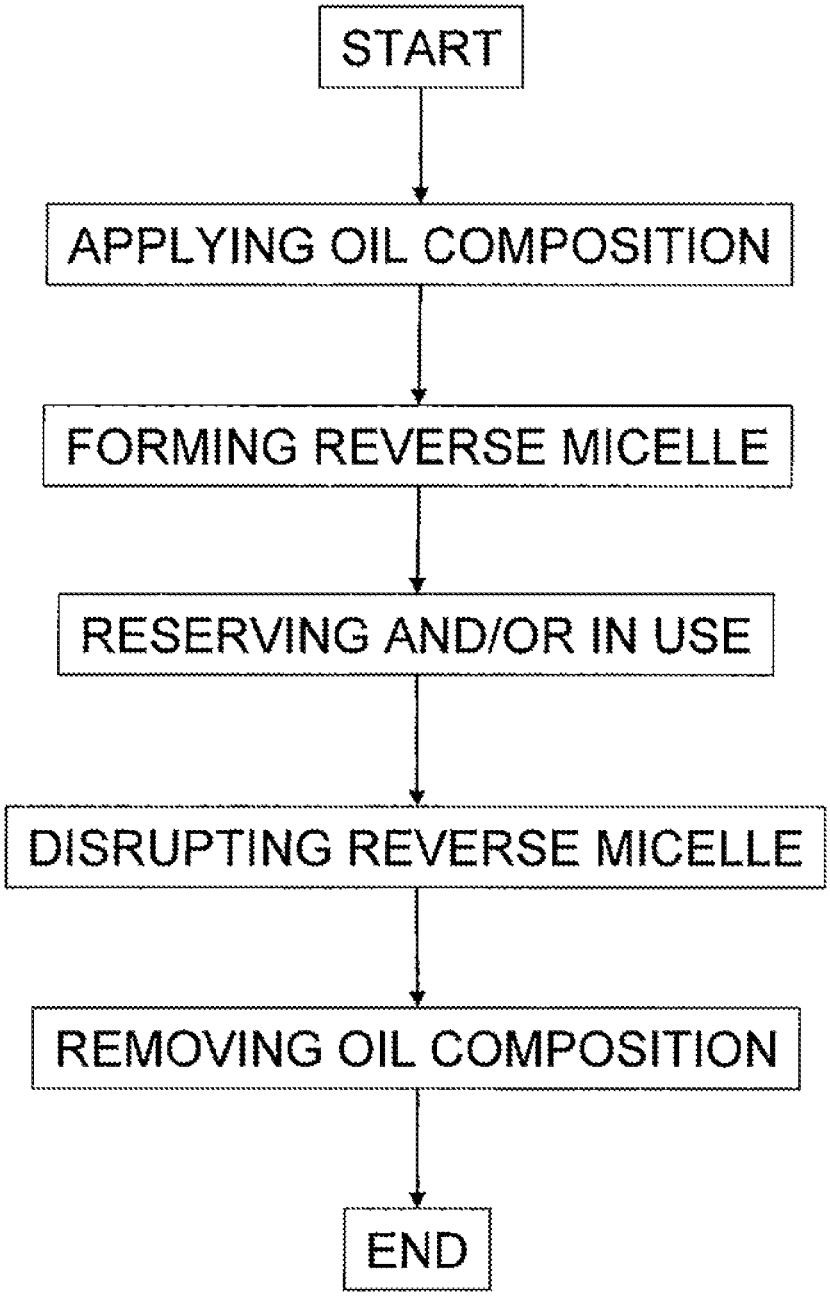
FIG. 2 is a flow chart showing an example of a method for using the composition comprising a reverse micelle.

The composition can be used as described below, for example as also shown in FIG. 2. Firstly, the composition can be applied to an article such as a machine part (for example, a part containing metal or made of metal). Examples of articles include an article having small, deep and/or complicated pores or holes such as a hydraulic valve or actuator; a large scaled article being transported by a freighter such as parts of a wind generator; and an article that preferably never rusts such as a crankshaft, a hydraulic valve or a hydraulic pump. The composition can be applied by a wide variety of application methods, such as dip application, spray application, roll application or brush application. In such an application, the composition may or may not contain at least one reverse micelle. When the articles have small holes (especially blind holes), tubes, hollows, or other indentations or portions that are relatively inaccessible, and the composition is to be applied into those areas, the composition can be easily applied into those areas if the composition does not contain reverse micelles since the viscosity would be relatively low. The viscosity of the composition can be increased after application by promoting formation of reverse micelles. If the composition contains reverse micelles during the application process and the viscosity is relatively high, the composition can be applied directly or can be stored for later use. Alternatively, if during this process the composition does not contain reverse micelles and the viscosity is relatively low, the reverse micelles can be formed to increase the viscosity of the composition in response to photostimulation such as visible light irradiation or electric stimulation such as electrolytic oxidation. Subsequently, the article can be provided for its intended use or can be stored. Lubrication or antirust protection can be imparted to the treated article over extended periods of time, as the high viscosity composition will be resistant to removal, elution, or erosion.

At some point in time after treatment of an article, an operator may wish to remove the composition from the treated article. This removal is made easier by converting the composition from a relatively high viscosity state to a relatively low viscosity state. Disrupting the reverse micelle structure by applying an appropriate stimulus will decrease the viscosity of the composition. The stimulus can be any appropriate stimulus such as photostimulation, ultraviolet light irradiation, electric stimulation, or electrolytic reduction such as discussed above. Since the lower viscosity facilitates removal of the composition from the article, a higher degree of removal can be achieved using less effort and decreased amounts of cleaners, solvents, and times relative to cleaning a conventionally treated article. Additionally, negative effects caused by residual compositions remaining on the article after cleaning will be reduced in subsequent steps such as when welding, painting, plating, bonding, and other secondary processings are performed on the cleaned article.

The degrees of photostimulation and electric stimulation are not particularly limited, and can be determined according to the type and use of each component such as the first and second compounds. For the degree of photostimulation, the amount of irradiation of light can be, for example, about 100 J/cm$^2$ or more. For the degree of electric stimulation, the applied voltage can be, for example, about +0.15V or more and can be about +0.5V or more.

The invention claimed is:

1. A composition comprising a first compound and second compound in an oil wherein:

the first compound comprises an organic acid, sodium chloride, hydrogen phthalate, or a substituted or unsubstituted cinnamic acid or a salt or ester thereof;

the second compound has a first conformation that forms a reverse micelle interaction with the first compound;

the second compound has a second conformation that disrupts or prevents formation of a reverse micelle;

the second compound changes conformation in response to a stimulus; and the viscosity of the composition is higher in the presence of the reverse micelle than in the absence of the reverse micelle.

2. The composition according to claim 1, wherein the second compound is a surfactant.

3. The composition according to claim 1, wherein the stimulus is at least one of photostimulation and electric stimulation.

4. The composition according to claim 1, wherein the change in conformation is reversible.

5. The composition according to claim 1, wherein the second compound is capable of disrupting the reverse micelle in response to irradiation with ultraviolet light.

6. The composition according to claim 1, wherein the second compound comprises a photoswitchable azobenzene-modified surfactant.

7. The composition according to claim 1, wherein the second compound comprises a quaternary ammonium salt of an azobenzene compound.

8. The composition according to claim 1, wherein the second compound comprises a compound represented by the following general formula (1):

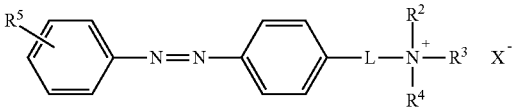

(1)

wherein $R^2$, $R^3$ and $R^4$ each independently represent a lower alkyl group or form a pyridinium with the nitrogen atom, $R^5$ represents an alkyl group, L represents an alkylene group or an alkylene-oxy group and X represents a halogen atom.

9. The composition according to claim 8, wherein the second compound comprises at least one selected from the group consisting of 4-butylazobenzene-4'-(oxyethyl)trimethylammonium bromide, 4-butylazobenzene-4'-(oxyethyl)trimethylammonium chloride, 4-hexylazobenzene-4'-(oxyethyl)trimethylammonium bromide, 4-hexylazobenzene-4'-(oxyethyl) trimethylammonium chloride, 4-octylazobenzene-4'-(oxyethyl)trimethylammonium bromide, and 4-octylazobenzene-4'-(oxyethyl)trimethylammonium chloride.

10. The composition according to claim 6, wherein the second compound comprises a quaternary ammonium salt other than the photoswitchable azobenzene-modified surfactant.

11. The composition according to claim 10, wherein the second compound comprises a compound represented by the following general formula (2):

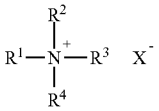

(2)

wherein $R^1$ represents an alkyl group having 14 to 18 carbon atoms, $R^2$, $R^3$ and $R^4$ each independently represent a lower alkyl group or forms a pyridinium with the nitrogen atom, and X represents a halogen atom.

12. The composition according to claim 10, wherein the second compound comprises at least one selected from the group consisting of cetyltrimethylammonium bromide, cetyltrimethylammonium chloride, cetylpyridinium chloride, octadecyltrimethylammonium bromide, octadecyltrimethylammonium chloride and octadecylpyridinium chloride.

13. The composition according to claim 1, wherein the second compound is capable of disrupting the reverse micelle in response to electrolytic oxidation.

14. The composition according to claim 1, wherein the second compound comprises a redox-active ferrocenyl surfactant.

15. The composition according to claim 14, wherein the redox-active ferrocenyl surfactant comprises (11-ferrocenylundecyl)trimethylammonium bromide.

16. The composition according to claim 1, wherein the second compound further comprises a quaternary ammonium salt, and the first compound comprises at least one selected from the group consisting of a substituted cinnamic acid, an unsubstituted cinnamic acid, a salt thereof and an ester thereof.

17. The composition according to claim 16, wherein the quaternary ammonium salt comprises at least one selected from the group consisting of cetyltrimethylammonium bromide, cetyltrimethylammonium chloride, cetylpyridinium chloride, octadecyltrimethylammonium bromide, octadecyltrimethylammonium chloride, and octadecylpyridinium chloride.

18. The composition according to claim 16, wherein the first compound comprises at least one selected from the group consisting of cis-cinnamic acid, trans-cinnamic acid, sodium cinnamate, potassium cinnamate, α-methylcinnamic acid, 2-methylcinnamic acid, 2-fluorocinnamic acid, 2-(trifluoromethyl)cinnamic acid, 2-chlorocinnamic acid, 2-methoxycinnamic acid, 2-hydroxycinnamic acid, 2-nitrocinnamic acid, 2-carboxycinnamic acid, trans-3-fluorocinnamic acid, 3-(trifluoromethyl)cinnamic acid, 3-chlorocinnamic acid, 3-bromocinnamic acid, 3-methoxycinnamic acid, 3-hydroxycinnamic acid, 3-nitrocinnamic acid, 4-methylcinnamic acid, 4-fluorocinnamic acid, trans-4-(trifluoromethyl)-cinnamic acid, 4-chlorocinnamic acid, 4-bromocinnamic acid, 4-methoxycinnamic acid, 4-hydroxycinnamic acid, 4-nitrocinnamic acid, 3,3-dimethoxycinnamic acid, ethyl 4-methoxycinnamate, isopropyl 4-methoxycinnamate, octyl 4-methoxycinnamate, 2-ethoxyethyl 4-methoxycinnamate, sodium 4-methoxycinnamate, potassium 4-methoxycinnamate and glyceryl ethylhexanoate dimethoxycinnamate.

19. The composition according to claim 4, wherein the first compound comprises at least one selected from the group consisting of a substituted cinnamic acid, an unsubstituted cinnamic acid, a salt thereof and an ester thereof.

20. The composition according to claim 1, wherein the first compound comprises an organic acid.

21. The composition according to claim 20, wherein the organic acid composes salicylic acid.

22. The composition according to claim 1, wherein the oil comprises at least one selected from the group consisting of mineral oil, plant oil and synthetic oil.

23. The composition according to claim 1, wherein the oil comprises at least one selected from the group consisting of paraffin oil, naphthene oil, aliphatic acid or derivative thereof, grease-base oil, poly-a-olefin, polyol ester and siloxane.

24. The composition according to claim 1, having viscosity at 40° C. in the presence of the reverse micelle higher than viscosity at 40° C. in the absence of the reverse micelle.

25. The composition of claim 1, wherein the viscosity of the composition in the presence of the reverse micelle is about $4\times10^{-3}$ to about $1000\times10^{-3}$ Pa·s at 40° C.

26. A composition comprising a first compound and a second compound in an oil wherein:

the second compound comprises at least one selected from cetyltrimethylammonium chloride, cetylpyridinium chloride, octadecyltrimethylammonium bromide, and octadecyltrimethylammonium chloride;

the second compound has a first conformation that forms a reverse micelle interaction with the first compound;

the second compound has a second conformation that disrupts or prevents formation of a reverse micelle;

the second compound changes conformation in response to a stimulus; and the viscosity of the composition is higher in the presence of the reverse micelle than in the absence of the reverse micelle.

27. The composition of claim 26 further comprising an azobenzene-modified surfactant.

28. The composition of claim 26 further comprising at least one selected from a substituted or unsubstituted cinnamic acid, a salt thereof and an ester thereof.

29. The composition of claim 26, wherein the viscosity of the composition in the presence of the reverse micelle is about $4\times10^{-3}$ to about $1000\times10^{-3}$ Pa·s at 40° C.

30. A composition comprising a first compound and a second compound in an oil wherein:

the first compound comprises an organic acid, sodium chloride, hydrogen phthalate, or a substituted or unsubstituted cinnamic acid or a salt or ester thereof;

the second compound comprises at least one selected from cetyltrimethylammonium chloride, cetylpyridinium chloride, octadecyltrimethylammonium bromide, and octadecyltrimethylammonium chloride;

the second compound has a first conformation that forms a reverse micelle interaction with the first compound;

the second compound has a second conformation that disrupts or prevents formation of a reverse micelle;

the second compound changes conformation in response to a stimulus; and the viscosity of the composition is higher in the presence of the reverse micelle than in the absence of the reverse micelle.

31. The composition of claim 30 further comprising an azobenzene-modified surfactant.

32. The composition of claim 30, wherein the viscosity of the composition in the presence of the reverse micelle is about $4\times10^{-3}$ to about $1000\times10^{-3}$ Pa·s at 40° C.

* * * * *

UNITED STATES PATENT AND TRADEMARK OFFICE

CERTIFICATE OF CORRECTION

PATENT NO. : 8,993,494 B2
APPLICATION NO. : 13/144544
DATED : March 31, 2015
INVENTOR(S) : Kusuura It is certified that error appears in the above-identified patent and that said Letters Patent is hereby corrected as shown below:

In the Specification

In Column 1, Line 7, delete "35 U.S.C. §371" and insert -- 35 U.S.C. § 371 --, therefor.

In Column 5, Line 23, delete "Salicyclic" and insert -- Salicylic --, therefor.

In Column 6, Line 11, delete "additives;" and insert -- additives, --, therefor.

In Column 7, Line 35, delete "adjustments" and insert -- adjustment --, therefor.

In the Claims

In Column 8, Line 47, in Claim 1, delete "and second" and insert -- and a second --, therefor.

In Column 10, Line 51, in Claim 23, delete "poly-a-olefin," and insert -- poly-α-olefin, --, therefor.

Signed and Sealed this
Twenty-ninth Day of September, 2015

Michelle K. Lee

Michelle K. Lee
*Director of the United States Patent and Trademark Office*